US006009944A

United States Patent [19]

Gudmestad

[11] Patent Number: 6,009,944

[45] Date of Patent: Jan. 4, 2000

[54] PLUG LAUNCHING DEVICE

[75] Inventor: Tarald Gudmestad, Naerbo, Norway

[73] Assignee: Weatherford/Lamb, Inc., Houston, Tex.

[21] Appl. No.: 09/077,168

[22] PCT Filed: Dec. 6, 1996

[86] PCT No.: PCT/GB96/03006

§ 371 Date: May 21, 1998

§ 102(e) Date: May 21, 1998

[87] PCT Pub. No.: WO97/21019

PCT Pub. Date: Jun. 12, 1997

[30] Foreign Application Priority Data

Dec. 7, 1995 [GB] United Kingdom ..... 9525044

[51] Int. Cl.[7] ..... E21B 33/13

[52] U.S. Cl. ..... 166/192; 166/153

[58] Field of Search ..... 166/153, 155, 166/156, 192, 196

[56] References Cited

U.S. PATENT DOCUMENTS

| | | | |
|---|---|---|---|
| 3,006,415 | 10/1961 | Burns et al. . | |
| 3,545,542 | 12/1970 | Scott | 166/155 |
| 3,616,850 | 11/1971 | Scott | 166/155 |
| 3,633,671 | 1/1972 | Nelson | 166/156 |
| 3,635,288 | 1/1972 | Lebourg | 166/156 |
| 3,768,556 | 10/1973 | Baker | 166/154 |
| 3,768,562 | 10/1973 | Baker | 166/289 |
| 3,789,926 | 2/1974 | Henley et al. | 166/244 R |
| 3,971,436 | 7/1976 | Lee | 166/70 |
| 4,042,014 | 8/1977 | Scott | 166/5 |
| 4,047,566 | 9/1977 | Duke | 166/285 |
| 4,164,980 | 8/1979 | Duke | 166/291 |
| 4,674,569 | 6/1987 | Revils et al. | 166/154 |
| 4,674,573 | 6/1987 | Bode | 166/291 |
| 4,706,747 | 11/1987 | Schneider | 166/153 |
| 4,917,184 | 4/1990 | Freeman et al. | 166/285 |
| 5,004,048 | 4/1991 | Bode | 166/70 |
| 5,024,273 | 6/1991 | Coone et al. | 166/289 |

(List continued on next page.)

FOREIGN PATENT DOCUMENTS

| | | |
|---|---|---|
| 0 306 306 A1 | 9/1987 | European Pat. Off. . |
| 0 306 306 | of 1988 | European Pat. Off. . |
| 0 450 676 B1 | 3/1990 | European Pat. Off. . |
| 450 676 B1 | of 1991 | European Pat. Off. . |
| 0 500 165 A1 | 2/1991 | European Pat. Off. . |
| 0450676 A1 | 10/1991 | European Pat. Off. . |
| 0500165 A1 | 2/1992 | European Pat. Off. . |
| 0 598 558 A1 | 11/1992 | European Pat. Off. . |
| 0697496 A2 | 8/1994 | European Pat. Off. . |
| 0 697 496 A2 | of 1995 | European Pat. Off. . |
| 2115860 | 3/1982 | United Kingdom . |
| 2 115 860 | of 1983 | United Kingdom . |
| WO 94/27026.A1 | 11/1994 | WIPO . |

OTHER PUBLICATIONS

Derwent's Abstracts, No. 83–799631/43, week 8343, Abstract of S.U. 983252—Dec. 23, 1982.

Int'l Search Report, PCT/GB96/03006.

Int'l Prelim. Examination Report, PCT/GB96/03006.

Fasdrop Head, LaFleur Petroleum Services, 1992.

*Primary Examiner*—Frank Tsay

*Attorney, Agent, or Firm*—Guy McClung

[57] ABSTRACT

A plug launching device for use in cementing operations in the construction of oil and gas wells, the device having, in certain embodiments, a tubular member with an upper section and a lower section which can accommodate at least a bottom plug and a top plug, the upper section having a floor and the lower section movable relative to the upper section so that when a first dart is pumped into the upper section by cement, the cement is diverted to raise the lower section to release the bottom plug, and when a second dart is pumped into the upper section by hydraulic fluid, it lands on the first dart and the hydraulic fluid is diverted to raise the lower section to further release the top plug.

9 Claims, 2 Drawing Sheets

U.S. PATENT DOCUMENTS

Figure 1A:
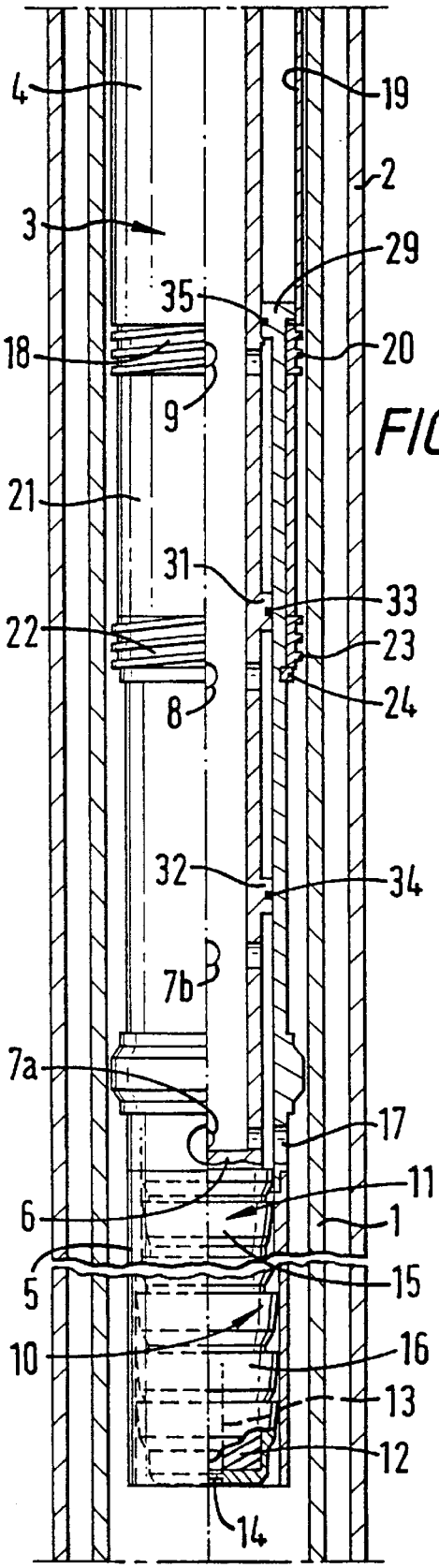

| | | | |
|---|---|---|---|
| 5,095,988 | 3/1992 | Bode | 166/291 |
| 5,165,474 | 11/1992 | Buisine et al. | 166/242 |
| 5,178,216 | 1/1993 | Giroux et al. | 166/242 |
| 5,224,540 | 7/1993 | Streich et al. | 166/118 |
| 5,246,069 | 9/1993 | Glaser et al. | 166/156 |
| 5,279,370 | 1/1994 | Brandell et al. | 166/386 |
| 5,390,736 | 2/1995 | Budde | 166/153 |
| 5,392,852 | 2/1995 | Laurel et al. | 166/153 |
| 5,413,172 | 5/1995 | Laurel | 166/153 |
| 5,435,390 | 7/1995 | Baugh et al. | 166/285 |
| 5,443,122 | 8/1995 | Brisco | 166/285 |
| 5,553,667 | 9/1996 | Budde et al. | 166/70 |
| 5,762,139 | 6/1998 | Sullaway et al. | 166/291 |
| 5,765,641 | 6/1998 | Shy et al. | 166/292 |
| 5,787,979 | 8/1998 | Giroux et al. | 166/177.4 |
| 5,813,457 | 9/1998 | Giroux et al. | 166/153 |
| 5,829,526 | 11/1998 | Rogers et al. | 166/291 |
| 5,833,022 | 11/1998 | Holcombe | 166/291 |
| 5,856,790 | 1/1999 | Baugh et al. | 340/854.6 |

PLUG LAUNCHING DEVICE

This invention relates to a plug launching device for use in cementing operations in the construction of oil and gas wells.

During the construction of oil and gas wells a wellbore is bored in the ground. A string of casing is lowered into the wellbore and the annular space between the casing and the wellbore filled with cement.

When the cement is set the wellbore is extended and the process repeated. Conventionally the new length of casing is referred to as a "liner" until such time as it is cemented in place after which it is referred to as "casing".

Typically, the liner is lowered on a work string and is releasably attached thereto by a running tool which, as shown in EP-A-0 450 676 (which forms the basis of the pre-characterising clause of claim 1) may include a plug launching device which accommodates a top plug and a bottom plug for use in the subsequent cementing operation.

Once the liner is in position a liner hanger is set. This secures the liner to the casing. Circulating fluid is then pumped through the tool string and the liner and returns in the annular space between the liner and the wellbore thereby removing the majority of mud and debris therefrom. At this stage a first dart is introduced into the work string and is pumped down the work string by a column of cement. In EP-A-0 450 676 the dart passes down the running tool and engages a plunger which ejects the bottom plug.from the running tool. When operating properly the dart should come to rest on top of the plunger with the cement leaving the running tool above the dart and passing down the liner on top of the bottom plug.

When the required quantity of cement has been pumped down the work string a second dart is introduced into the work string and pumped down with hydraulic fluid. Typically circulating fluid or sea water is used for this purpose.

When the second dart engages the first dart it displaces the plunger further downwardly thus releasing the top plug which is pumped down the liner on top of the cement by the hydraulic fluid.

A float shoe is installed at or near the bottom of the liner. The bottom plug travels down the liner until it lands on the float shoe. Since the top plug is being pumped down the liner by the hydraulic fluid the pressure on the bottom plug increases until a frangible diaphragm therein ruptures and allows the cement to pass through the bottom plug and the float shoe and flow upwards into the annulus between the liner and the wellbore until the top plug lands on the bottom plug. The float shoe incorporates a non-return valve and the cement is allowed to set in the annulus.

The difficulty with the known arrangement is that if the first dart is pumped down the work string too rapidly it can impact the plunger with sufficient force to launch both the top and bottom plugs together.

The present invention addresses this problem by preventing the first darts from mechanically ejecting the plugs.

According to the present invention there is provided a plug launching device for use in cementing operations in the construction of oil and gas wells, said plug launching device comprising a tubular member having an upper section and a lower section which can accommodate at least a bottom plug and a top plug, characterised in that said upper section has a floor and said lower section is movable relative to said upper section, the arrangement being such that, in use, when a first dart is pumped into said upper section by cement said cement is diverted to raise said lower section to release said bottom plug and when a second dart is pumped into said upper section by hydraulic fluid it lands on said first dart and said cement is diverted to raise said lower section further to release said top plug.

Preferably, said upper section and said lower section are generally cylindrical and said lower section is telescopically movable with respect to said upper section.

Advantageously, the wall of that part of said lower section which accommodates said top plug and said bottom plug is imperforate. This feature, whilst not absolutely essential, is highly desirable since it inhibits the plugs being unintentionally launched by the flow of fluid thereby.

Preferably, said upper section is provided with at least two series of holes which are spaced apart from one another along said upper section.

Advantageously, said upper section is provided with at least two lands which project outwardly from said upper section and are provided with seals which engage said lower section.

Preferably, an upper portion of said lower section is provided with a flange which projects inwardly from said lower section and is provided with a seal which engages said upper section.

Advantageously, said lower section is provided with at least one outlet which, in use, allows fluid to pass from said upper section.

Whilst the plug launching device is primarily intended for use in conjunction with a running tool for lowering and setting a liner it could also be used for launching plugs at a wellhead, more particularly but not exclusively a sub-sea wellhead.

The present invention also provides a running tool incorporating a plug launching device in accordance with the present invention.

Preferably, said running tool is adapted for lowering and setting a liner in casing and subsequently cementing said liner in position.

For a better understanding of the present invention reference will now be made, by way of example, to the accompanying drawings, in which:

FIGS. 1*a*, 1*b*, 1*c* and 1*d* are sequential drawings, partly in cross-section and partly in side elevation, showing a plug launching device in accordance with the present invention in operation.

Referring to the drawings, there is shown a liner 1 which is suspended within a casing 2 by a conventional liner hanger (not shown) which comprises a plurality of cone segments and slips which act between the liner 1 and the casing 2.

A plug launching device, which is generally identified by reference numeral 3 extends downwardly into the liner 1 and forms part of a running tool which is suspended from a work string (not shown).

The plug launching device 3 comprises an upper section 4 and a lower section 5 which are separated by a floor 6.

As shown in FIG. 1*a* the upper section 4 is generally cylindrical and is provided with two series of holes 7*a*, 7*b* at a lower level, a series of holes 8 at an intermediate level, and a series of holes at an upper level 9.

The lower section 5 contains a bottom plug 10 and a top plug 11.

The bottom plug 10 comprises a main body portion 12 which is provided with a passageway 13 which terminates in a rupture disk 14. The bottom plug 10 is also provided with a plurality of resilient fins 16 which are radially restrained by the side of the lower section 5.

The top plug 11 is generally similar to the bottom plug 10 except the main body portion 15 is solid and is not provided with a passageway or a rupture disk.

The lower section 5 is telescopically mounted on the upper section 4 and is spaced therefrom by two lands 31 and 32 which are each provided with a seal 33, 34 which engage the lower section 5. The lower section 5 is also provided with a series of outlet holes 17 which are aligned with the holes 7*a* in the initial position shown in FIG. 1*a*. The lower section 5 is provided with a first collar 18 which abuts the bottom of a tube 19 fast with the upper section 4. The first collar 18 is provided with a thread 20 which is intended to be sheared and is supported by a spacer 21 which rests on a second collar 22 which is also provided with a thread 23 which is intended to be sheared and is supported by a circlip 24.

The operation of the plug launching device will now be described.

After the casing 2 is cemented in position the wellbore is extended. The liner 1 is then lowered down the casing 2 on the running tool which is mounted on the bottom of the tool string. If the liner 1 encounters an obstruction it is reciprocated up and down and rotated whilst circulating fluid is pumped down the liner and allowed to return through the annular space between the liner 1 and the wellbore until the obstruction is cleared. During circulation the circulating fluid passes through the upper section 4, outwardly through the series of holes 7*a* and 7*b* in the lower layer, through outlets 17 and flows down the liner 1.

Figure 1B:
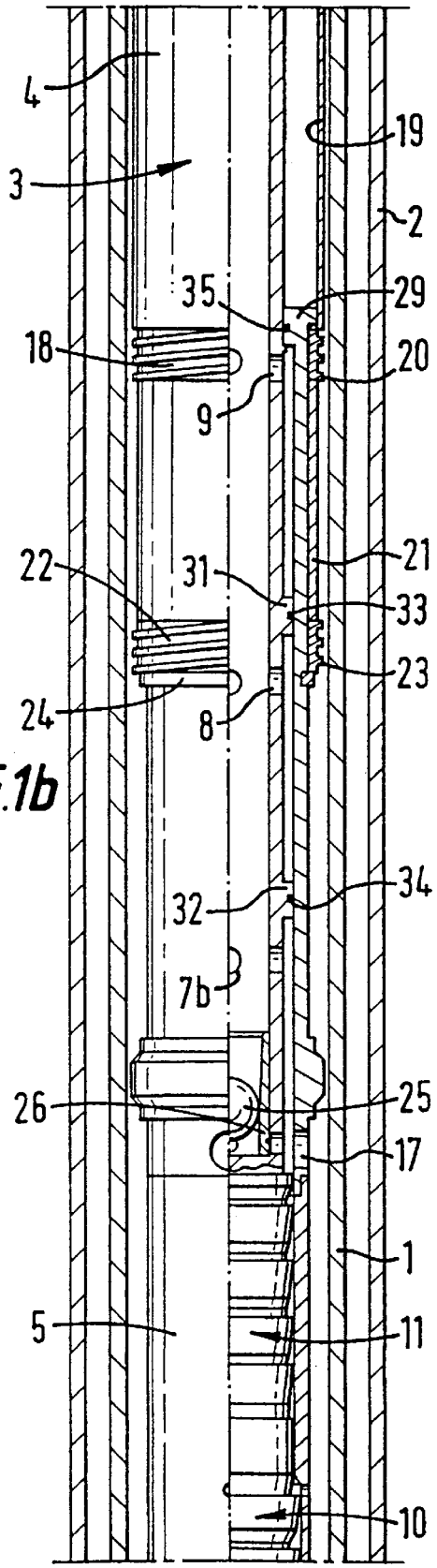

After the liner 1 has been lowered to the desired position adjacent the bottom of the casing 2 it is set in position by hydraulically actuating a liner hanger. This is typically effected by dropping a metal ball down the work string until it engages a valve seat in the running tool. This diverts the circulating fluid to the liner hanger which is set as the pressure increases. After the liner hanger is set the pressure is increased to activate a mechanism to allow the running tool to be withdrawn from the liner 1 and then further increased to displace both the metal ball and its seat which drop down the running tool and come to rest on the floor 6 of the upper section. This is shown in FIG. 1*b* where the metal ball is identified by reference numeral 25 and the displaced seat by 26. It will be noted that the seat 26 obstructs the series of holes 7*a* although fluid can still pass through the series of holes 7*b*.

Conventionally the running tool is raised by a few meters at this time to demonstrate that the liner 1 has been successfully released. The running tool is then lowered to its previous position and the cementing process commenced.

At this stage circulating fluid is pumped down the work string and passes through the upper section 4, radially outwardly through the holes 7*b*, down the liner 1 and returns through the annular space between the liner 1 and the wellbore (FIG. 1*b*). This removes debris from the annular space and prepares it for cementing.

When the annular space is to receive the cement a first dart 27 is released into the top of the work string from a dart release box (not shown). The first dart 27 is pumped down the work string by cement 28. The first dart 27 travels down the work string until it comes to rest on top of the metal ball 25 at which position it obstructs the holes 7*b*. The cement then flows through the holes 8 and 9.

Because the holes 7*a* and 7*b* are blocked the pressure of the cement increases and acts upwardly against a flange 29 which projects inwardly from the top of the lower section 5 and is provided with a seal 35 which engages the upper section 4. The cement urges the lower section 5 upwardly relative to the upper section 4.

When the pressure builds up sufficiently the thread 20 fractures against the tube 19 and the lower section 5 rises until the thread 23 of the second collar 22 abut the bottom of the tube 19 at which time the outlet holes 17 in the lower section 5 are in full fluid communication with the holes 8 so that cement can flow therethrough.

Figure 1C:
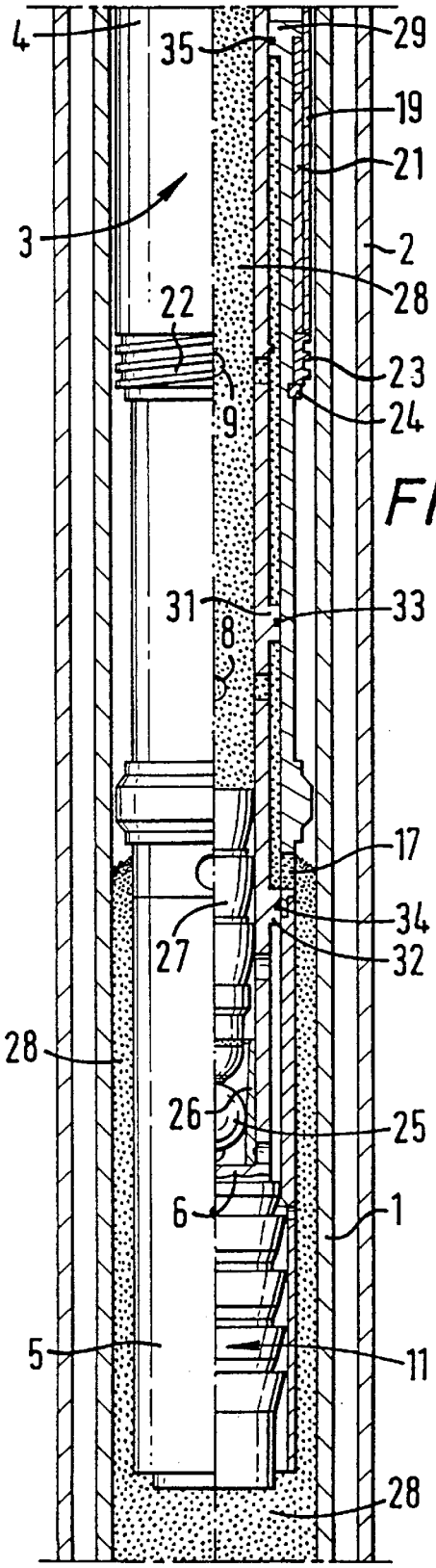

As the lower section 5 rises the bottom plug 10 is progressively exposed so that the resilient fins 16 spring radially outwardly and engage the wall of the liner 1. As shown in FIG. 1*c*, after the cement is pumped down the work string it passes through the holes 8 and outlet 17 and down the liner 1 pushing the bottom plug 10 before it. For the purpose of explanation the cement is shown flowing downwardly from the outlets 17. However, it will be appreciated that some cement also flows upwardly into the annular space between the lower section section 5 and the liner 1. This flow is conventionally contained by a packer which may act between the tube 19 and the liner 1.

When sufficient cement has been introduced into the work string a second dart 30 is introduced into the top of the work string and pumped down by a convenient source of hydraulic fluid. Circulating fluid is typically used for this purpose.

Figure 1D:
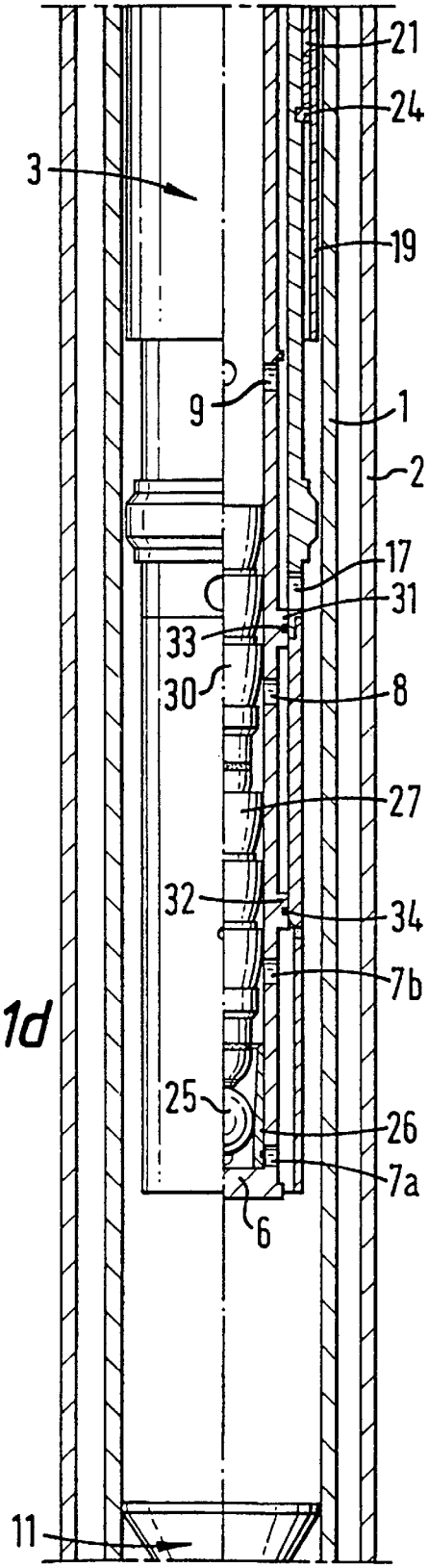

When the second dart 30 lands on the first dart 27 it blocks flow through the holes 8. The pressure of the circulating fluid builds up and is applied to the flange 29 via holes 9. When sufficient pressure builds up the thread 23 is sheared so that the lower section 5 travels upwardly relative to the lower section until fluid communication is established between the holes 9 and the outlet 17 as shown in FIG. 1*d*.

As the lower section 5 rises it exposes the top plug 11 whose resilient fins expand outwardly against the liner 1. The circulating fluid is pumped through the holes 9 and outlets 17 into the liner 1 where it drives the column of cement trapped between the bottom plug 10 and the top plug 11 down the liner 1 until the bottom plug 10 lands on a float collar installed adjacent the bottom of the liner 1.

The pressure of the circulating fluid on the top plug 11 is increased until the rupture disk 14 fails allowing the cement to pass through the bottom plug 10 and the float shoe and flows radially outwardly and upwardly into the annulus between the liner 1 and the wellbore until the top plug 11 lands on the bottom plug 10.

The work string and the running tool may then be withdrawn.

The top plug 11, bottom plug 10, the float shoe and any residual cement may be drilled out if it is desired to further extend the well.

It will be noted that the first dart 27, the second dart 30, the metal ball 25 and its seat 26 are all recovered in the launching device thereby minimising the accumulation of debris in the well and allowing refurbishment and reuse of these parts if desired.

As thus far described it will be noted that the bottom plug 10 and top plug 11 are merely held in the lower section 5 by compression. Whilst this should be quite adequate it may be felt that some form of mechanical latching device be provided which prevents the plugs being inadvertently launched before the lower section 5 is raised. With this in mind the top plug 11 may be releasably secured to the floor 6 of the upper section 4 and the bottom plug 10 releasably secured to the top plug 11. A suitable releasable securing arrangement for the top plug 11 might comprise, for example, a spring loaded latch pivotally mounted on the floor 6 and having a member projecting into the top plug 11 and held in position by the lower section 5 acting against the action of the spring. When the lower section 5 is raised to its uppermost position the spring loaded latch is uncovered and springs back releasing the top plug 11. Similarly, the top plug 11 may be provided with a similar spring loaded latch for retaining the bottom plug 10 until the latch is released when the lower section 5 is raised sufficiently.

Various modifications to the plug launching device are envisaged, for example the lower section 5 could be adapted to hold any number of plugs which are individually releasable in response to the landing of a dart in the upper section 4 and the blocking of a separate series of holes to raise the lower section 5 by the desired amount to release a plug.

The launching device is primarily intended for launching cementing plugs. However, it could also be used for launching plugs for other purposes, for example wiper plugs which are intended to clean the side of the liner or setting plugs which are intended to activate items mounted in the liner. The darts are preferably of the shape shown for cementing operations as they can be used to separate the circulating fluid from the cement. However, for other purposes the dart could comprise any member capable of blocking flow through a series of holes.

I claim:

1. A plug launching device for use in cementing operations in the construction of oil and gas wells, said plug launching device (3) comprising a tubular member having an upper section (4) and a lower section (5) which can accommodate at least a bottom plug (10) and a top plug (11), characterized in that said upper section has a floor (6) and said lower section is movable relative to said upper section (4), the arrangement being such that, in use, when a first dart (27) is pumped into said upper section (4) by cement said cement is diverted to raise said lower section (5) to release said bottom plug (10) and when a second dart (30) is pumped into said upper section (4) by hydraulic fluid it lands on said first dart (27) and said hydraulic fluid is diverted to raise said lower section (5) further to release said top plug (11).

2. A plug launching device as claimed in claim 1, wherein said upper section (4) and said lower section (5) are generally cylindrical and said lower section (5) is telescopically movable with respect to said upper section (4).

3. A plug launching device as claimed in claim 1 or 2, wherein a part of said lower section which accommodates said top plug (11) and said bottom plug (10) includes a wall that is imperforate.

4. A plug launching device as claimed in claim 1, wherein said upper section (4) is provided with at least two series of holes **(7*a*, 7*b*, 8, 9) which are spaced apart from one another along said upper section (4)**.

5. A plug launching device as claimed in any preceding claim 1, wherein said upper section (4) is provided with at least two lands (31, 32) which project outwardly from said upper section (4) and are provided with seals (33, 34) which engage said lower section (5).

6. A plug launching device as claimed in claim 5, wherein an upper portion of said lower section (5) is provided with a flange (29) which projects inwardly from said lower section (5) and is provided with a seal (34) which engages said upper section (4).

7. A plug launching device as claimed in claim 1, wherein said lower section is provided with at least one outlet (17) which, in use, allows fluid to pass from said upper section (4).

8. A running tool incorporating a plug launching device as claimed in claim 1.

9. A running tool as claimed in claim 8, for lowering and setting a liner in casing and subsequently cementing said liner in position.

* * * * *